US012129081B1

(12) United States Patent
Lee

(10) Patent No.: US 12,129,081 B1
(45) Date of Patent: Oct. 29, 2024

(54) CONTAINER

(71) Applicant: Wen-Ho Lee, Taichung (TW)

(72) Inventor: Wen-Ho Lee, Taichung (TW)

( * ) Notice: Subject to any disclaimer, the term of this patent is extended or adjusted under 35 U.S.C. 154(b) by 0 days.

(21) Appl. No.: 18/131,275

(22) Filed: Apr. 5, 2023

(51) Int. Cl.
*B65D 43/02* (2006.01)

(52) U.S. Cl.
CPC ..... *B65D 43/0212* (2013.01); *B65D 43/0233* (2013.01); *B65D 2543/00537* (2013.01); *B65D 2543/00574* (2013.01); *B65D 2543/00777* (2013.01)

(58) Field of Classification Search
CPC ..... B65D 43/0212; B65D 43/0233; B65D 2543/00537; B65D 2543/00574; B65D 2543/00777; B65D 2543/00296; B65D 2543/00555
See application file for complete search history.

(56) References Cited

U.S. PATENT DOCUMENTS

| | | | | |
|---|---|---|---|---|
| 11,661,248 | B2 * | 5/2023 | Wang | B65D 43/162 220/833 |
| 2017/0144805 | A1 * | 5/2017 | Zhou | B65D 43/0212 |
| 2021/0362921 | A1 * | 11/2021 | Krueger | B65D 55/024 |
| 2023/0150732 | A1 * | 5/2023 | Bullock | E05C 19/14 220/839 |

* cited by examiner

*Primary Examiner* — Shawn M Braden
(74) *Attorney, Agent, or Firm* — Ying-Ting Chen; Law Office of Michael Chen

(57) ABSTRACT

A container may include a main body, and a lid is adapted to couple on the main body. The main body has at least two first hinge portions, at least two connecting recesses, and two broken lines respectively formed on the connecting recesses, and the lid comprises at least two cover planes. When the lid is coupled on the main body, the user can pull and detach the first hinge portion from the cover plane to enable the lid to be openable, and the connecting recess is split free from the broken line to make the first hinge portion to be not engaged with the lid again, so that the user can easily identify whether the lid is opened, so as to improve the protection effect of the container.

4 Claims, 9 Drawing Sheets

CONTAINER

FIELD OF THE INVENTION

The present invention relates to a container and more particularly to a container with discernible function when opened by intentional person.

BACKGROUND OF THE INVENTION

The traditional plastic lunch box, including a lid and a box body, mainly use the box body to contain food, and then sealed through the lid. The lid comprises a top portion, and a side part extending from the outer edges of the top portion to the direction of the box body. The side part is adapted to cover around the upper end of the box body, and the lid is fixed on the box body to achieve the sealing effect.

However, the conventional container has following disadvantages: the lid covers the box body only through the side part, although the engaging point design on the side wall of the box body can be fixed with the lid, when the box body or the lid is pressed to be deformed, the engaging point may be failed to lose the sealing effect of the container, leading to the food inside the box spilled out. Also, the engaging point design allows the lid to be repeatedly closed and opened, so that it is difficult for consumers to tell whether the lid has been opened by intentional persons, so as to cause risk. Therefore, there remains a need for a new and improved design for a container to overcome the problems presented above.

SUMMARY OF THE INVENTION

The present invention provides a main body, and a lid is adapted to couple on the main body. The main body has a first peripheral edge on the outer periphery of an upper opening of the main body, and at least two first coupling portions are respectively and horizontally extended outward from the first peripheral edge at the symmetrical positions. Each of the first coupling portions comprises a connecting plane, and a connecting protrude is formed at the center portion of the connecting plane. Each of the locating arc surfaces is formed on the outer vertical surface of the first peripheral edge at the position aligned with the connecting plane. Each of first hinge portions is extended from the outer edge of the connecting plane of the first coupling portion, and each of first bending portions is formed between the first hinge portion and the first coupling portion so as to allow the first hinge portion to be folded toward the connecting plane. Each of the first hinge portions has a connecting recess formed thereon, and the connecting recess is engaged and secured with the connecting protrude, and the periphery of the connecting recess comprises a broken line. The outer periphery of the lid comprises a second peripheral edge, and the inner side of the second peripheral edge is configured to couple with and cover the first peripheral edge of the main body. At least two first cover portions respectively protrude outwardly from the periphery of the second peripheral edge at the symmetrical positions, and the first cover portions respectively cover and couple with the first coupling portions. Each of the first cover portions comprises a cover plane, and the cover plane is adapted to be coupled and positioned on the connecting plane. Each of concaved curved surfaces is formed on the outer vertical surface of the second peripheral edge at the position aligned with the cover plane. Each of the cover planes has a through hole thereon, and each of the connecting protrude is adapted to pass through the through hole. The diameter of the through hole is larger than the diameter of the broken line of the connecting recess.

In one embodiment, each of two lateral sides of the connecting plane has a locating protrude, and the positions of the two locating protrudes are higher than the connecting plane, and each of the locating protrudes is connected to the connecting plane through a first oblique plane.

In another embodiment, each of two lateral sides of the cover plane has a shell portion, and the positions of the shell portions are higher than the cover plane, and each of the shell portions is connected to the cover plane through a second oblique plane.

In still another embodiment, the connecting protrude is formed in a conical cylinder shape, and the connecting recess is formed in a tapered shape so as to tightly engage with the connecting protrude.

In a further embodiment, the first peripheral edge of the main body comprises at least two protruded second coupling portions at the symmetrical positions, and each of the second coupling portions has a second hinge portion on the outer edge thereof; each of second bending portions is formed between the second hinge portion and the second coupling portion, and each of the second coupling portions has a coupling protrude formed at the center portion of the second coupling portion, and each of two lateral sides of the coupling protrude comprises a coupling recess; each of the second hinge portions has a first engaging portion protruding from the surface thereof, and the second peripheral edge of the lid has at least two protruded second cover portions at the symmetrical positions, and the second cover portions are respectively coupled with and cover the second coupling portions; each of the second cover portions has an engaging protrude formed at the center portion thereof, and each of two lateral sides of the engaging protrude has a locating recess; the engaging protrude is hollow inside and correspondingly covers the outer side of the coupling protrude, and the locating recesses are respectively coupled with the coupling recesses to complete positioning.

Comparing with conventional container, the present invention is advantageous because: with the designs of the connecting recess and the broken line, when the lid is coupled on the main body, the user can pull and detach the first hinge portion from the cover plane to enable the lid to be openable, and the connecting recess is split free from the broken line to make the first hinge portion to be not engaged with the lid again, so that the user can easily identify whether the lid is opened, so as to improve the protection effect of the container.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
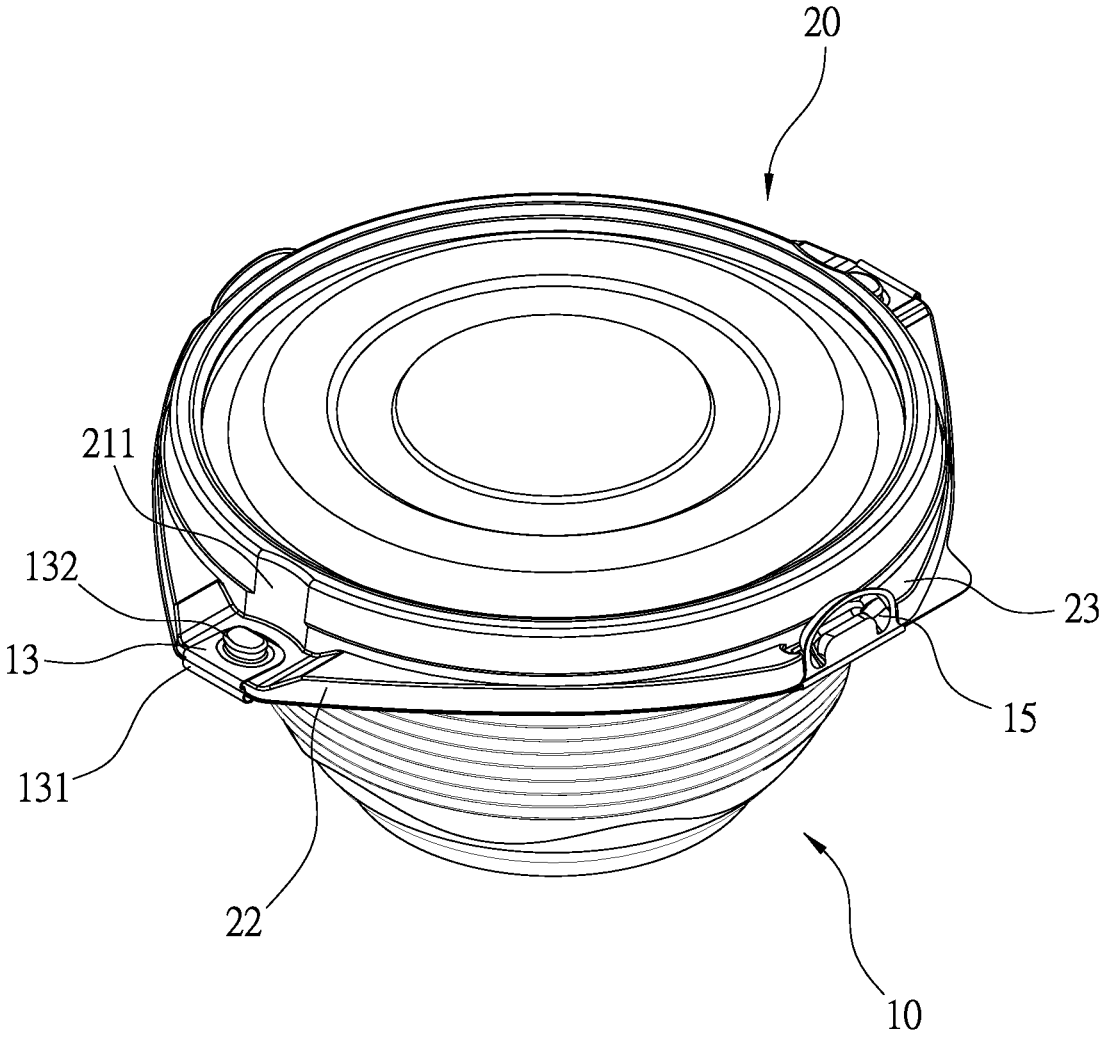
FIG. 1 is a three-dimensional assembly view of a container of the present invention.
Figure 2:
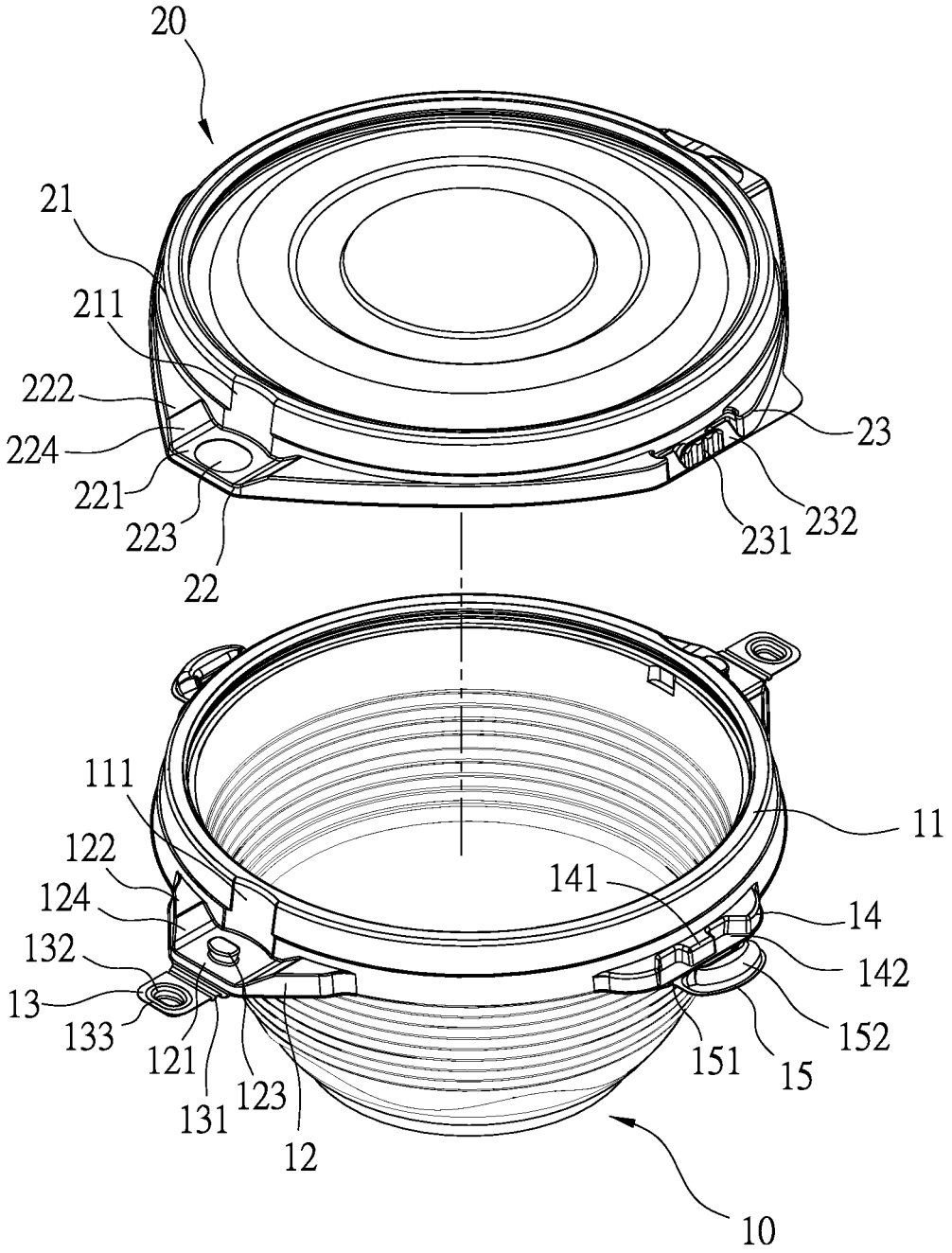
FIG. 2 is a three-dimensional exploded view of the container of the present invention.
Figure 3:
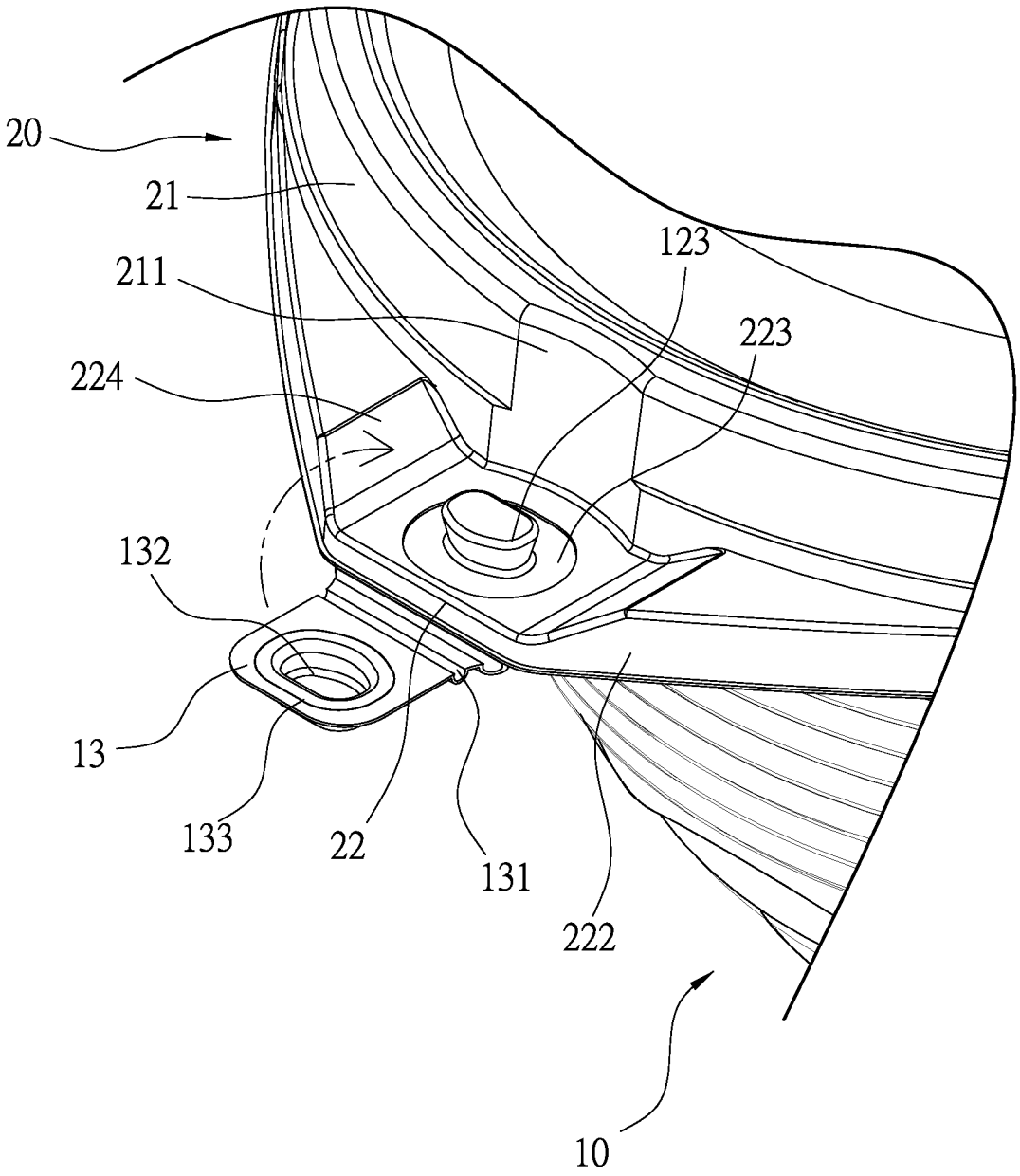
FIG. 3 is a schematic view illustrating a lid is coupled and cover the upper opening of a main body of the container without clamping in the present invention.
Figure 4:
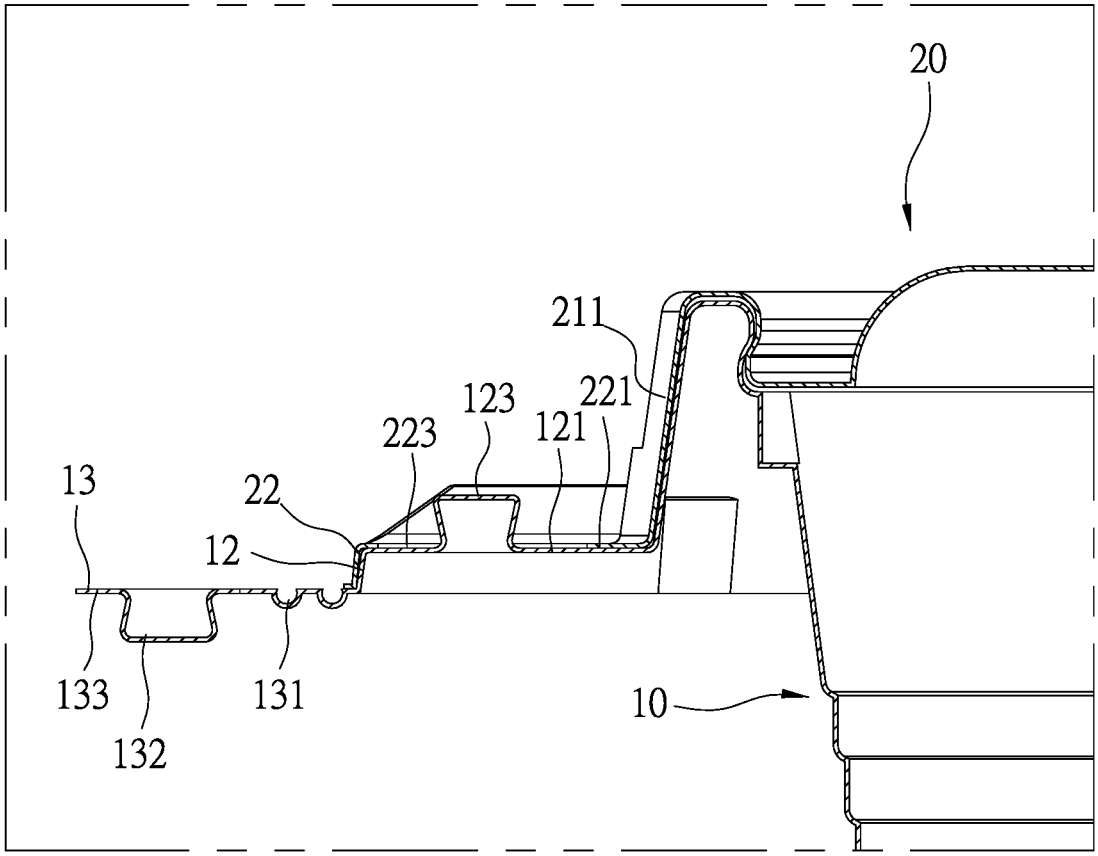
FIG. 4 is a sectional view illustrating the lid is coupled and cover the upper opening of the main body of the container without clamping in the present invention.
Figure 5:
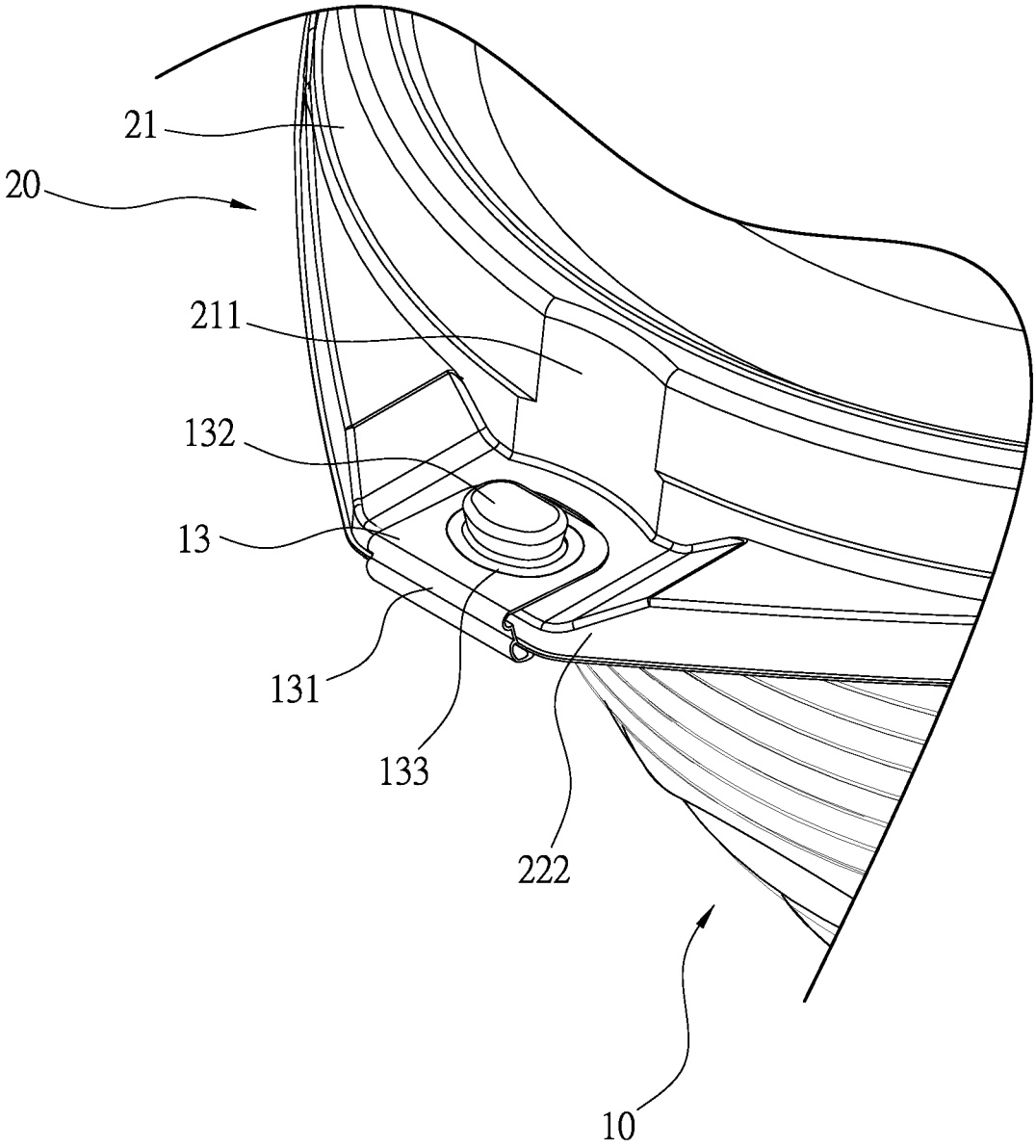
FIG. 5 is a schematic view illustrating the lid is coupled and cover the upper opening of the main body of the container with clamping in the present invention.
Figure 6:
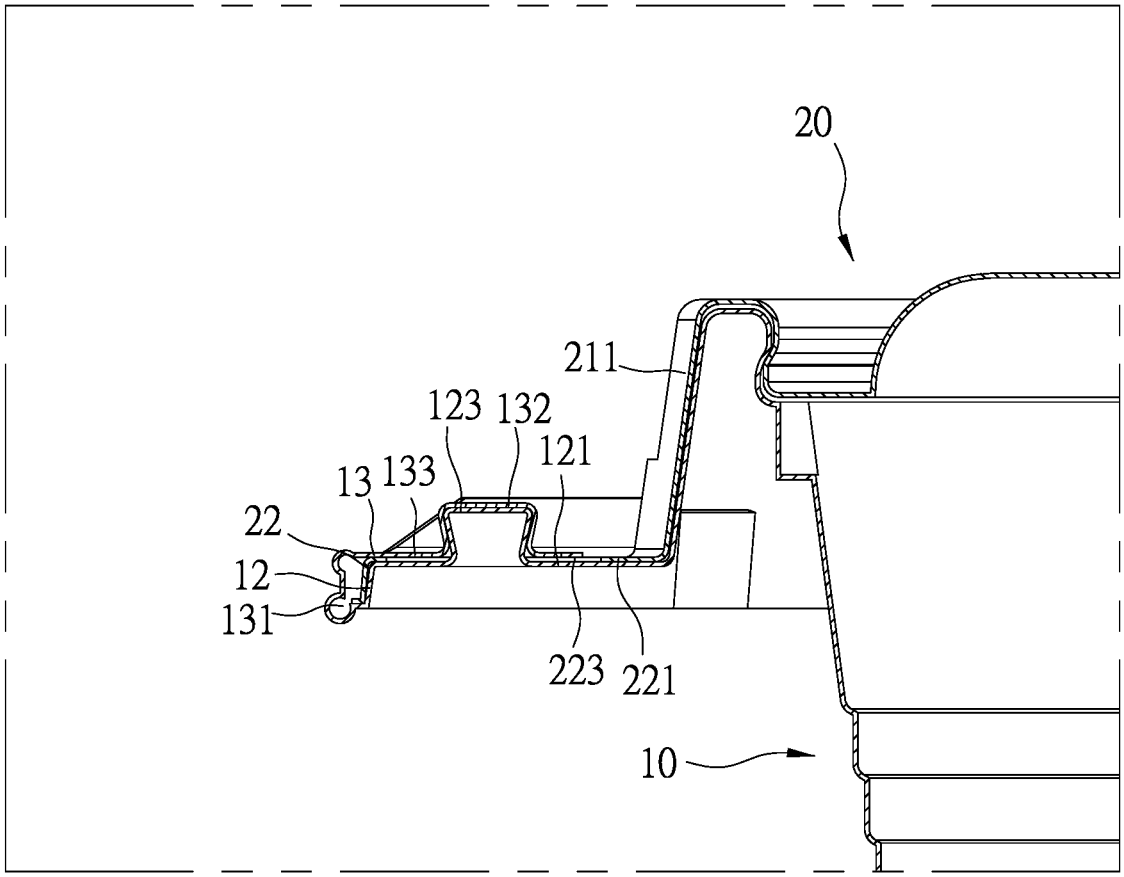
FIG. 6 is a sectional view illustrating the lid is coupled and cover the upper opening of the main body of the container with clamping in the present invention.

In order to further understand the goal, characteristics and effect of the present invention, a number of embodiments along with the drawings are illustrated as following:

Referring to FIGS. 1 and 2, the present invention provides a container comprising a main body (10), and a lid (20) is adapted to couple on the main body (10). The main body (10) has a first peripheral edge (11) on the outer periphery of an upper opening of the main body (10), and at least two first coupling portions (12) are respectively and horizontally extended outward from the first peripheral edge (11) at the symmetrical positions. Each of the first coupling portions (12) comprises a connecting plane (121), and each of two lateral sides of the connecting plane (121) has a locating protrude (122), and a connecting protrude (123) is formed at the center portion of the connecting plane (121), and the connecting protrude (123) is formed in a conical cylinder shape. The positions of the two locating protrudes (122) are higher than the connecting plane (121), and each of the locating protrudes (122) is connected to the connecting plane (121) through a first oblique plane (124). Each of first hinge portions (13) is extended from the outer edge of the connecting plane (121) of the first coupling portion (12), and each of first bending portions (131) is formed between the first hinge portion (13) and the first coupling portion (12) so as to allow the first hinge portion (13) to be folded toward the connecting plane (121). Moreover, each of the first hinge portions (13) has a connecting recess (132) formed thereon, and the connecting recess (132) is formed in a tapered shape so as to tightly engage with the connecting protrude (123), and the periphery of the connecting recess (132) comprises a broken line (133). Additionally, each of the locating arc surfaces (111) is formed on the outer vertical surface of the first peripheral edge (11) at the position aligned with the connecting plane (121). The outer periphery of the lid (20) comprises a second peripheral edge (21), and the inner side of the second peripheral edge (21) is configured to couple with and cover the first peripheral edge (11) of the main body (10). At least two first cover portions (22) respectively protrude outwardly from the periphery of the second peripheral edge (21) at the symmetrical positions, and the first cover portions (22) respectively cover and couple with the first coupling portions (12). Each of the first cover portions (22) comprises a cover plane (221), and two lateral sides of the cover plane (221) respectively have two shell portions (222). Furthermore, each of the cover planes (221) has a through hole (223) thereon, and each of the connecting protrude (123) is adapted to pass through the through hole (223). The diameter of the through hole (223) is larger than the diameter of the broken line (133) of the connecting recess (132), and the positions of the shell portions (222) are higher than the cover plane (221). Also, each of the shell portions (222) is connected to the cover plane (221) through a second oblique plane (224), and each of concaved curved surfaces (211) is formed on the outer vertical surface of the second peripheral edge (21) at the position aligned with the cover plane (221).

In addition, the first peripheral edge (11) of the main body (10) comprises at least two protruded second coupling portions (14) at the symmetrical positions, and each of the second coupling portions (14) has a second hinge portion (15) on the outer edge thereof. Each of second bending portions (151) is formed between the second hinge portion (15) and the second coupling portion (14), and each of the second coupling portions (14) has a coupling protrude (141) formed at the center portion of the second coupling portion (14), and each of two lateral sides of the coupling protrude (141) comprises a coupling recess (142). Moreover, each of the second hinge portions (15) has a first engaging portion (152) protruding from the surface thereof. The second peripheral edge (21) of the lid (20) has at least two protruded second cover portions (23) at the symmetrical positions, and the second cover portions (23) are respectively coupled with and cover the second coupling portions (14). Each of the second cover portions (23) has an engaging protrude (231) formed at the center portion thereof, and each of two lateral sides of the engaging protrude (231) has a locating recess (232). The engaging protrude (231) is hollow inside and correspondingly covers the outer side of the coupling protrude (141), and the locating recesses (232) are respectively coupled with the coupling recesses (142) to complete positioning.

Structurally, referring to FIGS. 3 to 6, the second peripheral edge (21) of the lid (20) is adapted to couple with and cover the first peripheral edge (11) of the main body (10), and the first cover portions (22) and the second cover portions (23) are respectively aligned with and cover the first coupling portions (12) and the second coupling portions (14). When the first cover portions (22) are respectively coupled with the first coupling portions (12), the cover planes (221) are respectively coupled on the connecting planes (121), and the connecting protrudes (123) respectively penetrate through the through holes (223). Also, the shell portions (222) respectively cover and are positioned above the locating protrudes (122), and the inner side of the engaging protrudes (231) of the second cover portions (23) are respectively aligned with and cover the coupling protrudes (141). Furthermore, the locating recesses (232) are respectively coupled and positioned on the coupling recesses (142). The lid (20) is positioned on and cover the upper opening of the main body (10), and the second hinge portions (15) are upwardly folded to couple with the lid (20), and the first engaging portions (152) are respectively engaged with the engaging protrudes (231) of the second cover portions (23). The first hinge portions (13) are folded toward and coupled with the lid (20), and the connecting recesses (132) are respectively engaged with the connecting protrudes (123). Moreover, each of the cover planes (221) is coupled and positioned between the first hinge portion (13) and the connecting plane (121), so that the lid (20) is tightly secured on the main body (10).

Figure 7:
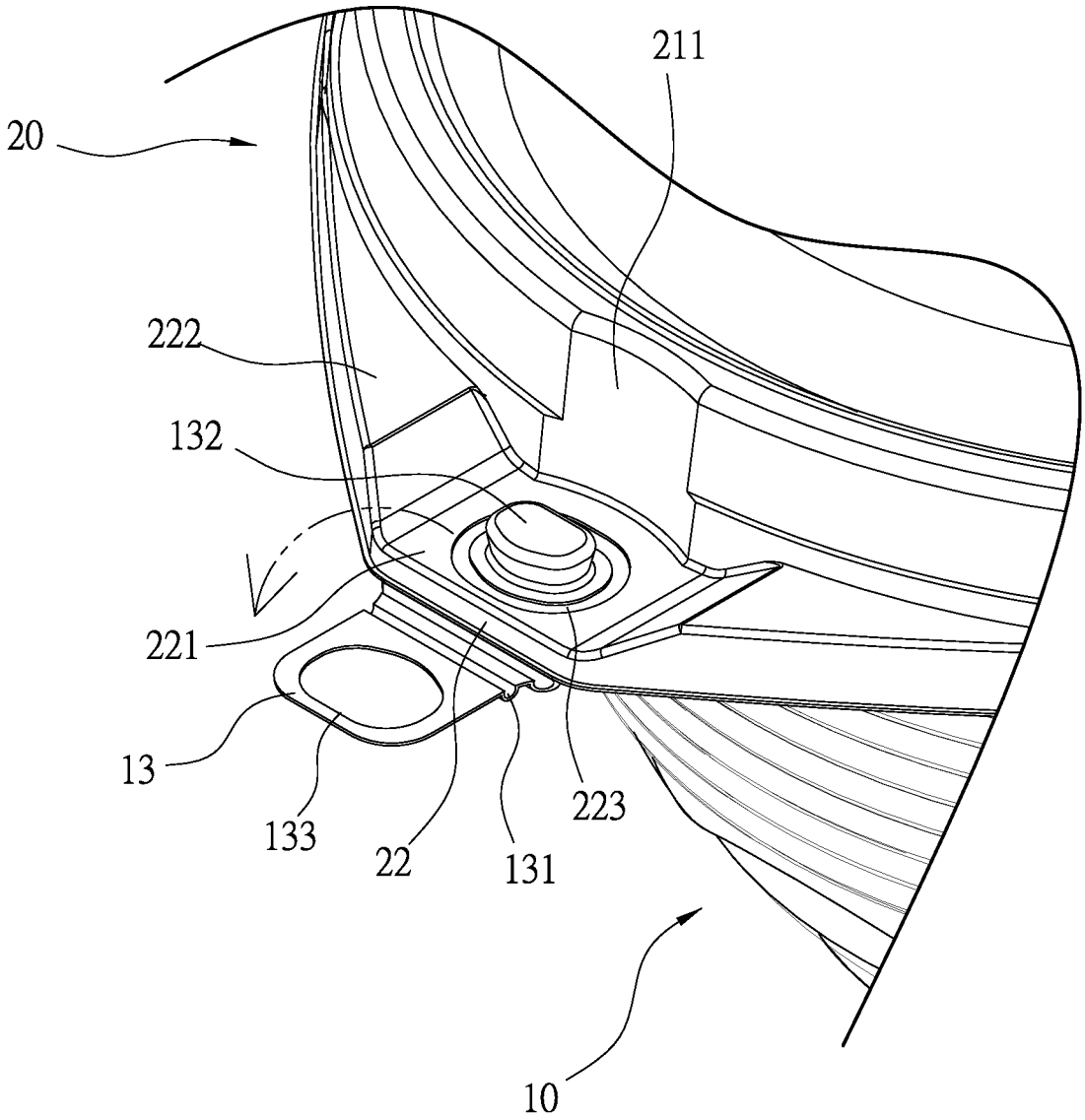
FIG. 7 is a schematic view illustrating a first hinge portion is pulled and detached from a cover plane of the container in the present invention.
Figure 8:
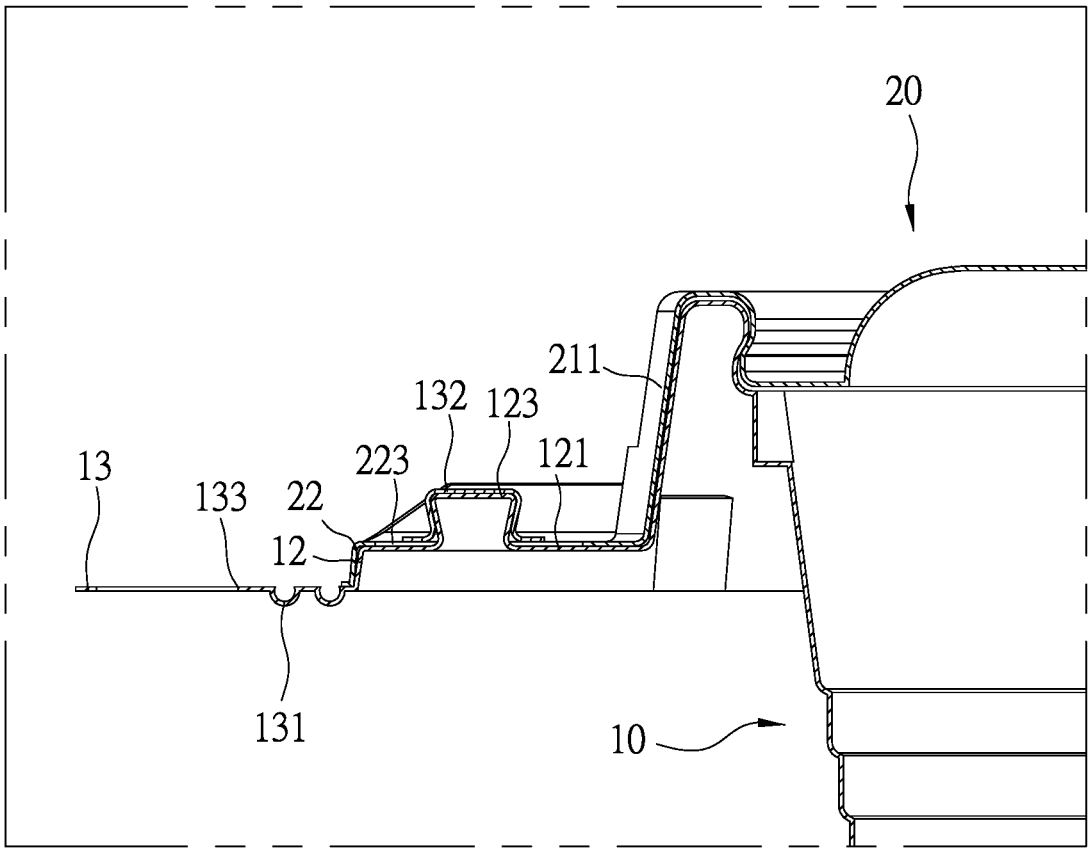
FIG. 8 is a sectional view illustrating the first hinge portion is pulled and detached from the cover plane of the container in the present invention.
Figure 9:
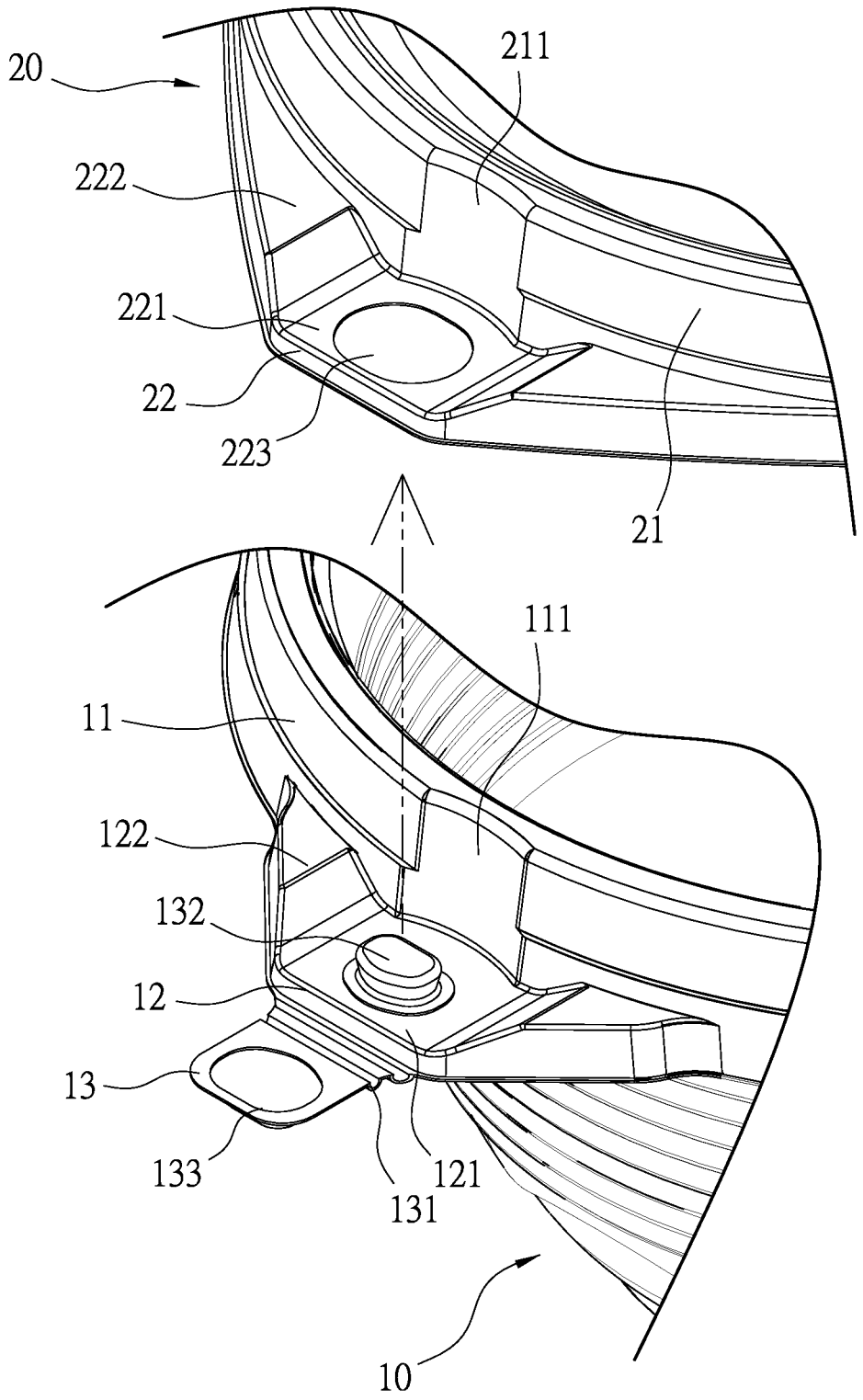
FIG. 9 is a schematic view illustrating the lid is opened and detached from the main body of the container in the present invention.

Referring to FIGS. 7 to 9, when the user needs to detach the lid (20) from the main body (10), the first hinge portions (13) and the second hinge portions (15) are disengaged from the first cover portions (22) and the second cover portions (23) respectively. Each of the broken lines (133) is formed on the periphery of the connecting recess (132), and with the design of conical cylinder shapes, each of the connecting recesses (132) is tightly coupled with the connecting protrude (123), so that when the first hinge portion (13) is pulled and detached from the first cover portion (22), the connecting recess (132) is split from the broken line (133) and detached form the first hinge portion (13), and the connecting recess (132) is configured to keep engaging with the connecting protrude (123). At the moment, the lid (20) is openable, and the first hinge portion (13) cannot be engaged with the first cover portion (22) once detached from the first cover portion (22). As a result, it will be obvious when the intentional person opens the lid (20) without permission, which can prevent the contents in the container from being touched, and also the container can be evidence for consumers to claim losses.

Moreover, with the concaved curved surfaces (211) on the second peripheral edge (21), the space between the first hinge portion (13) and the second peripheral edge (21) is increased, so as to facilitate the consumer to pull the first hinge portion (13), thereby improving the convenience of use.

Comparing with conventional container, the present invention is advantageous because: with the designs of the connecting recess (132) and the broken line (133), when the lid (20) is coupled on the main body (10), the user can pull and detach the first hinge portion (13) from the cover plane (221) to enable the lid (20) to be openable, and the connecting recess (132) is split free from the broken line (133) to make the first hinge portion (13) to be not engaged with the lid (20) again, so that the user can easily identify whether the lid (20) is opened, so as to improve the protection effect of the container.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A container comprising a main body, and a lid adapted to couple on the main body;

wherein the main body has a first peripheral edge on an outer periphery of an upper opening of the main body, and at least two first coupling portions are respectively and horizontally extended outward from the first peripheral edge at the symmetrical positions; each of the first coupling portions comprises a connecting plane, and a connecting protrude is formed at the center portion of the connecting plane; each of locating arc surfaces is formed on an outer vertical surface of a first peripheral edge at the position aligned with the connecting plane; each of the first hinge portions is extended from an outer edge of the connecting plane of a first coupling portion, and each of first bending portions is formed between the first hinge portion and the first coupling portion so as to allow the first hinge portion to be folded toward the connecting plane; each of the first hinge portions has a connecting recess formed thereon, and the connecting recess is engaged and secured with the connecting protrude, and the periphery of the connecting recess comprises a broken line; the outer periphery of the lid comprises a second peripheral edge, and the inner side of the second peripheral edge is configured to couple with and cover the first peripheral edge of the main body; at least two first cover portions respectively protrude outwardly from the periphery of the second peripheral edge at the symmetrical positions, and the first cover portions respectively cover and couple with the first coupling portions; each of the first cover portions comprises a cover plane, and the cover plane is adapted to be coupled and positioned on the connecting plane; each of concaved curved surfaces is formed on an outer vertical surface of the second peripheral edge at the position aligned with the cover plane; each of the cover planes has a through hole thereon, and each of the connecting protrude is adapted to pass through the through hole; and the diameter of the through hole is larger than the diameter of the broken line of the connecting recess, wherein each of two lateral sides of the connecting plane has a locating protrude, and the positions of the two locating protrudes are higher than the connecting plane, and each of the locating protrudes is connected to the connecting plane through a first oblique plane.

2. The container of claim 1, wherein each of two lateral sides of the cover plane has a shell portion, and the positions of the shell portions are higher than the cover plane, and each of the shell portions is connected to the cover plane through a second oblique plane.

3. The container of claim 1, wherein the connecting protrude is formed in a conical cylinder shape, and the connecting recess is formed in a tapered shape so as to tightly engage with the connecting protrude.

4. The container of claim 1, wherein the first peripheral edge of the main body comprises at least two protruded second coupling portions at the symmetrical positions, and each of the second coupling portions has a second hinge portion on the outer edge thereof; each of second bending portions is formed between the second hinge portion and the second coupling portion, and each of the second coupling portions has a coupling protrude formed at the center portion of the second coupling portion, and each of two lateral sides of the coupling protrude comprises a coupling recess; each of the second hinge portions has a first engaging portion protruding from the surface thereof, and the second peripheral edge of the lid has at least two protruded second cover portions at the symmetrical positions, and the second cover portions are respectively coupled with and cover the second coupling portions; each of the second cover portions has an engaging protrude formed at the center portion thereof, and each of two lateral sides of the engaging protrude has a locating recess; the engaging protrude is hollow inside and correspondingly covers the outer side of the coupling protrude, and the locating recesses are respectively coupled with the coupling recesses to complete positioning.

* * * * *